United States Patent [19]

Winkler

[11] Patent Number: 4,993,700

[45] Date of Patent: Feb. 19, 1991

[54] FACING MECHANISM FOR SHEET FEEDER

[75] Inventor: Theodore Winkler, Levittown, Pa.

[73] Assignee: Brandt, Inc., Bensalem, Pa.

[21] Appl. No.: 483,989

[22] Filed: Feb. 22, 1990

Related U.S. Application Data

[63] Continuation of Ser. No. 271,915, Nov. 15, 1988, abandoned.

[51] Int. Cl.[5] ..... B65H 29/00

[52] U.S. Cl. ..... 271/186; 209/534; 209/576

[58] Field of Search ..... 271/186, 185, 65, 225, 271/902, 302, 304, 270; 209/534, 576

[56] References Cited

U.S. PATENT DOCUMENTS

| | | | |
|---|---|---|---|
| 4,078,789 | 3/1978 | Kittredge et al. | 271/902 X |
| 4,420,153 | 12/1983 | Winkler et al. | 271/315 X |
| 4,474,365 | 10/1984 | DiBlasio | 271/315 X |
| 4,557,597 | 12/1985 | Iwama | 271/65 X |
| 4,613,747 | 9/1986 | McCarthy | 209/534 X |

FOREIGN PATENT DOCUMENTS

| | | | |
|---|---|---|---|
| 140453 | 6/1986 | Japan | 271/301 |
| 136474 | 6/1987 | Japan | 271/186 |

*Primary Examiner*—David H. Bollinger
*Attorney, Agent, or Firm*—Shenier & O'Connor

[57] ABSTRACT

Sheet-feeding apparatus in which documents having distinguishable sides are momentarily halted by transversely spaced rollers to examine the sheets for proper orientation. A high-speed gating roller directs properly oriented sheets along the normal feed path. Upon detecting an improperly oriented sheet, the gating roller is driven in a reverse direction to drive the sheet into an inversion pocket where it is inverted before being returned to the normal path. The feed members along the inversion path are driven at a greater speed than sheets along the normal path to return the inverted sheet to it proper position in the document stream.

5 Claims, 3 Drawing Sheets

FACING MECHANISM FOR SHEET FEEDER

This is a continuation of copending application Ser. No. 07/271,915, filed on Nov. 15, 1988, now abandoned.

BACKGROUND OF THE INVENTION

This invention relates to apparatus for facing, or inverting, sheets that have been fed in an incorrect orientation.

There are known in the art numerous machines for feeding documents such as currency from a stack for such operations as batching, counting or the like. Typical machines of this type are shown in DiBlasio U.S. Pat. No. 4,474,365 and Winkler et al U.S. Pat. No. 4,420,153. Often, when such machines are used to process currency, it will be found that a few items are incorrectly oriented in the input stack, so that the side that should face upwardly is facing downwardly. Usually, such items must be removed from the stream, since they cannot be handled in their improper orientation. This creates considerable inconvenience, since not only is the stream of correctly oriented documents disrupted, but the improperly oriented sheets must be eventually oriented, often requiring a separate operation.

SUMMARY OF THE INVENTION

One of the objects of my invention is to provide a sheet feeder which handles incorrectly oriented sheets.

Another object of my invention is to provide a sheet feeder which reorients sheets without disturbing the order in which they have been fed.

Other and further objects will be apparent from the following disclosure.

In general, my invention contemplates a sheet feeder in which sheets having distinguishable sides are examined as they are fed to determine their orientation. If the sheets are incorrectly oriented — i.e., facing the wrong direction, they are directed into an inverter pocket and "faced", or inverted before being returned to the stream at the same position in the stream relative to other sheets. Otherwise, the sheets are allowed to continue along the stream without being inverted. Preferably, the sheets are selectively diverted into the inverter pocket by means of a high-speed gating roller that is reversible to direct the sheets along the desired path. Further, the sheets to be inverted are preferably driven along the inverter path at a higher speed than along the normal path to compensate for the differences in path length. This allows closely spaced sheets to be inverted and returned to the main stream without disrupting the flow or altering the order of the sheets.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
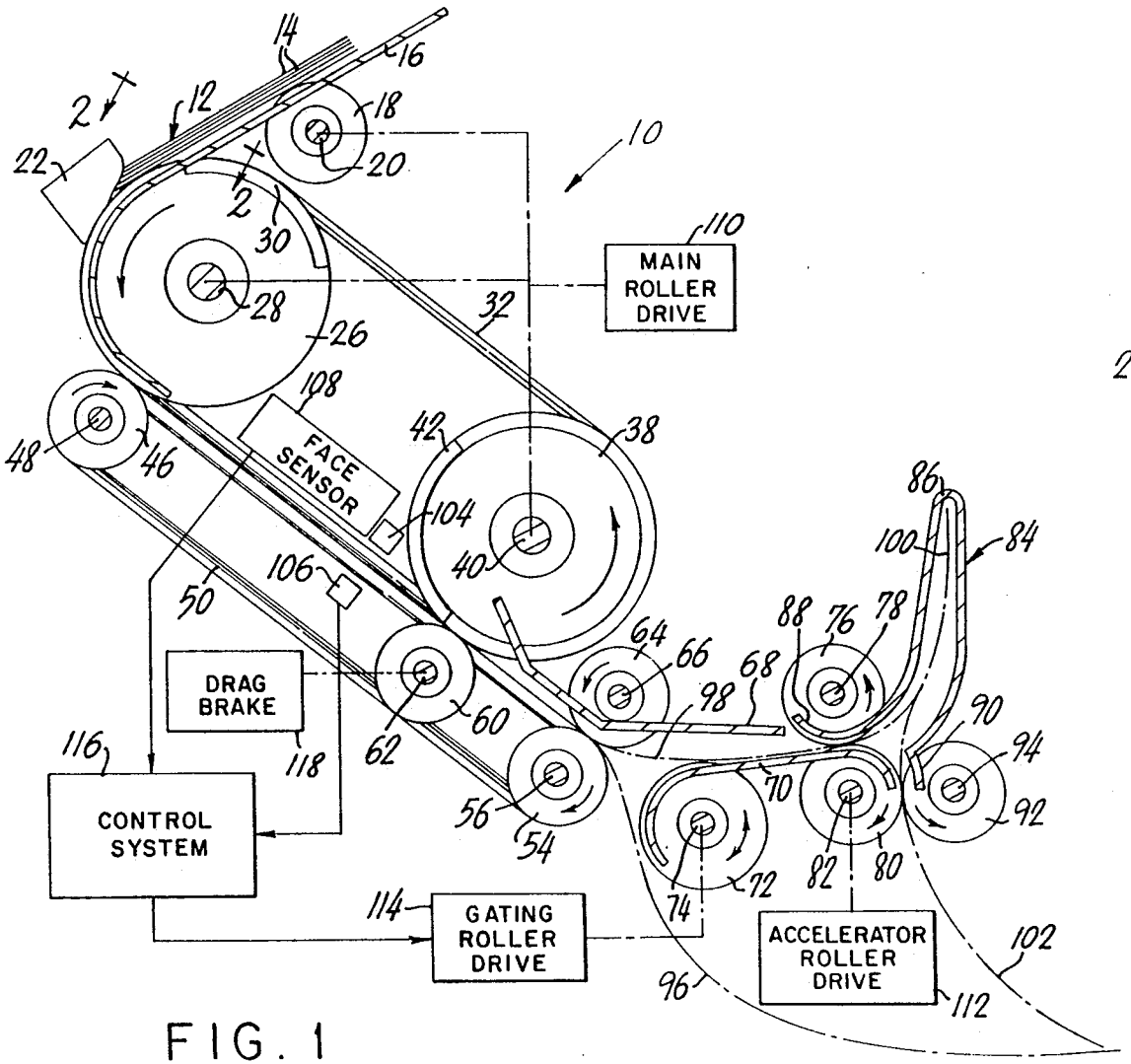
FIG. 1 is a section along line 1—1 of FIG. 3 of a sheet feeder incorporating my facing mechanism.

Referring now to FIG. 1, a sheet feeder incorporating my facing mechanism, indicated generally by the reference numeral 10, includes an input tray 16 for supporting a stack 12 of sheets 14, which may be paper currency of a specified denomination. As shown in FIG. 1, tray 16 is upwardly inclined toward the front of the feeder 10 (to the right in FIG. 1) to bias the stack 12 of sheets 14 into the nip formed by respective feed rollers 26 carried by a shaft 28 and stripper members 22 opposite rollers 26. One or more counterclockwise-driven picker rollers 18 mounted eccentrically on a shaft 20 below tray 16 extend upwardly through slots (not shown) in tray 16 during a portion of their rotation to urge the bottom sheet 14 into the feed nip formed by feed rollers 26 and stripper members 22.

Figure 2:
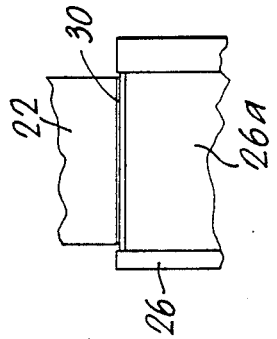
FIG. 2 is an enlarged view along line 2—2 of FIG. 1 of the feed nip of the sheet feeder shown in FIG. 1.
Figure 3:
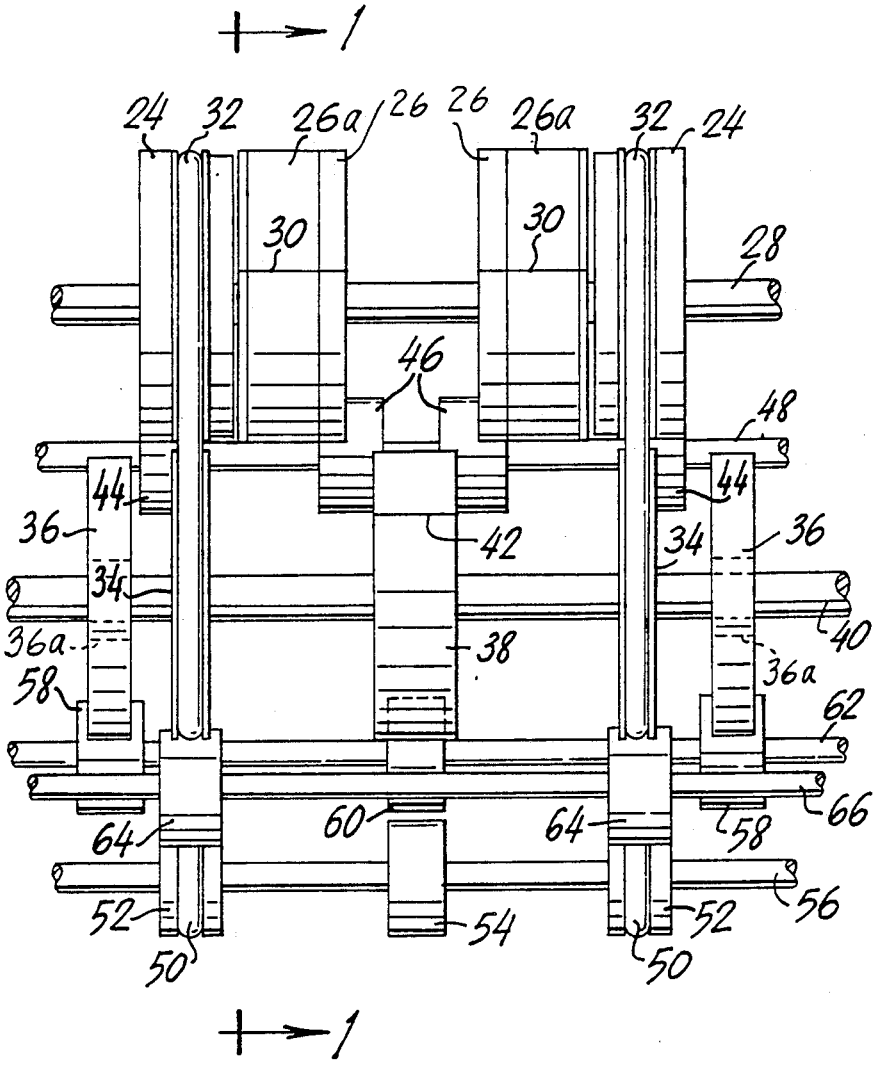
FIG. 3 is a fragmentary front elevation of the sheet feeder shown in FIG. 1, with parts omitted.

Referring now also to FIGS. 2 and 3, each of feed rollers 26 is formed with a slightly smaller-radius central portion **26*a* to form an indentation between the ends of the roller into which the corresponding stripper member 22 extends. Feed rollers 26 are generally formed of a low-friction material, but carry respective inserts 30 that extend over approximately 90° of the rollers' peripheries. As shown in FIG. 2, each of the inserts 30 has a radius slightly greater than that of the remaining portion 26*a* of the roller in order to grip a sheet 14 passing therebetween. Roller inserts 30 and stripper members 22 are formed of such materials that the coefficient of friction between a sheet 14 and the stripper member 22 is greater than that between two contacting sheets but less than the coefficient of friction between a sheet and the friction insert 30. Because of this relationship of frictional coefficients, stripper members 22 are generally effective to prevent the simultaneous feeding of more than a single sheet of paper. At the same time, inserts 30 grip the bottom sheet with sufficient frictional force to overcome the resistive force of stripper members 22**.

The shaft 28 supporting feed rollers 26 is driven by a main roller drive 110, preferably at a speed of 600 rpm in the embodiment shown. Main roller drive 110 also drives picker rollers 18 at a suitable peripheral velocity to advance sheets 14 from the bottom of the stack 12 into the feed nip. Shaft 28 carries a pair of pulleys 24 outboard of feed rollers 26. An O-ring belt 32 couples each pulley 24 to a pulley 34 carried by a shaft 40 downstream of shaft 28. Shaft 40 is also driven directly by the main roller drive 110 synchronously with shaft 28. Shaft 40 carries a pair of end rollers 36 outboard of pulleys 34 as well as a center drive roller 38 between the two pulleys. Respective clutch bearings **36*a* mount rollers 36 for rotation relative to shaft 40. Center roller 38 is similar in construction to the central portions 26*a* of feed rollers 26 and has a high-friction insert 42 extending over 90° of its periphery. The remaining portion 38*a* of the roller periphery is recessed radially inwardly, as shown in FIG. 1**.

After passing through the feed nip formed by feed rollers 26 and stripper members 22, the bottom sheet is directed by suitable guide members (not shown) into the nip formed by respective pulleys 44 opposite pulleys 24 and rollers 46 opposite the inboard rim portions of feed rollers 26. A shaft 48 supports pulleys 44 and rollers 46 for common rotation therewith. Respective O-rings 50 couple pulleys 44 to pulleys 52 carried by a shaft 56 disposed downstream from shaft 40 below the feed path. Shaft 56 also carries a center roller 54. Pulleys 52 oppose respective rollers 64 carried by a shaft 66 above the feed path. A shaft 62 intermediate shafts 48 and 56 supports end rollers 58 opposite rollers 36 and a center roller 60 opposite drive roller 38.

Shafts 48, 56 and 66 and the feed members carried by the shafts are driven frictionally through contact with opposing feed members to rotate at the same peripheral velocity as feed rollers 26. The shaft 62 supporting lower rollers 58 and 60, however, is coupled to a drag brake 118 of any suitable type known to the art. Sheets entering the upper nip between rollers 26 and 46 continue to move along with belts 32 and 50 until they reach the nip formed by rollers 36 and 58. There, lower rollers 58 and 60, which are stationary at this time, exert a braking force on the sheet to halt the sheet momentarily at the entrance to the nip. Upper end rollers 36, which frictionally engage lower end rollers 58 and which are rotatable relative to shaft 40, are also stationary at this time. If the arriving sheet is skewed, it will strike one of the opposing pairs of end rollers 36 and 58 first, rotating the sheet and thereby eliminating the skew. The sheet remains stationary until the friction insert 42 of drive roller 38 engages the sheet to drive lower center roller 60, and thus end rollers 58 and 36, against the retarding action of drag brake 118. Drive roller 38 draws the sheet 14 through the nip formed by rollers 38 and 60 and advances it into the nip formed by rollers 64 and 52 (FIG. 3).

Upon emerging from the nip formed by rollers 64 and 52, the sheet moves against a high-speed gating roller 72 which is carried by a shaft 74 driven by a gating roller drive 114. Roller 72, which is also described in Winkler et al U.S. Pat. No. 4,420,153, is preferably made of cork so as to be able to frictionally direct a sheet in the desired path while at the same time having a low moment of inertia. Normally, drive 114 rotates gating roller 72 counterclockwise to direct a sheet emerging from the nip formed by rollers 64 and 52 along a lower feed path 96 to a subsequent processing location (not shown). Suitable feed members (not shown) driven at the speed of rollers 26, together with passive guide members (not shown), may be provided along feed path 96 if desired to assist the feeding of sheets 14.

Figure 4:
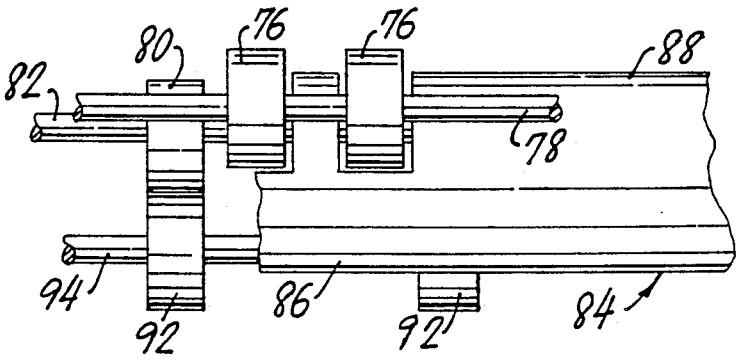
FIG. 4 is a fragmentary top plan of the facing mechanism of the sheet feeder shown in FIG. 1.

Referring now also to FIG. 4, clockwise rotation of roller 72 directs the sheet alternatively along an upper path 98 between upper and lower guides 68 and 70 into the nip formed by a pair of upper accelerator rollers 76 carried by a shaft 78 and lower accelerator rollers 80 carried by a shaft 82 outboard of rollers 76. Rollers 76 and 80 direct the sheet traveling along path 98 into the upwardly extending portion 86 of an inverter pocket indicated generally by the reference numeral 84. Inverter pocket 84 also has a leading portion 88 which cooperates with guide 70. Upon striking the upper inner surface of upwardly extending portion 86, the sheet, now at location 100, moves downwardly, retracing a portion of the original path and emerging from the inverter pocket 86 between accelerator rollers 80 and a pair of rollers 92 carried by a shaft 94 to the right of shaft 82 as viewed in FIG. 1. A trailing portion 90 of pocket 84 cooperates with a trailing portion of guide 70 to direct the sheet between rollers 80 and 92. The exiting sheet then moves along a path 102 which rejoins the path 96 traversed by a sheet 14 that has not been inverted.

Because of the greater length of the path traveled by the inverted sheet, rollers 80, and hence rollers 76 and 92, are driven by an accelerator roller drive 112 at a peripheral velocity in excess of that of feed rollers 26 and their associated feed members. Preferably, shaft 82 is driven at such a velocity as to equalize the transit times of documents traversing the lower path 96 and the upper path comprising portions 98, 100 and 102.

In the disclosed sheet feeder, sheets are directed upwardly of gating roller 72 if they are facing in the wrong direction in the original stack 12. To determine whether such is the case, the sheets are examined by a face sensor 108 disposed between feed rollers 26 and drive roller 38 as they are temporarily halted at the entrance to the drive roller nip. A photodetector 106 receptive to a light source 104 on the upper side of the feed path at the entrance to the drive roller nip provides a signal to a control system 116 for regulating the direction of the gating-roller drive 114. Face sensor 108, which also provides an input signal to the control system 116, measures the total reflectance of the adjacent portion of the upper side of the sheet 14. Face sensor 108 may include a light source (not separately shown), similar to source 104, and a photodetector (not separately shown), similar to detector 106, responsive to reflected light from an adjacent sheet 14. Since the two sides of a bill of a given denomination differ in their patterns of reflectance, face sensor 108 effectively senses the orientation of the sheet. Control system 116 may be of any suitable type known to the art, including in particular a microprocessor and associated circuits (not separately shown) for performing the necessary operations in a sequential manner. Other control circuits, including special-purpose digital circuits or even analog circuits, may also be used.

Figure 5:
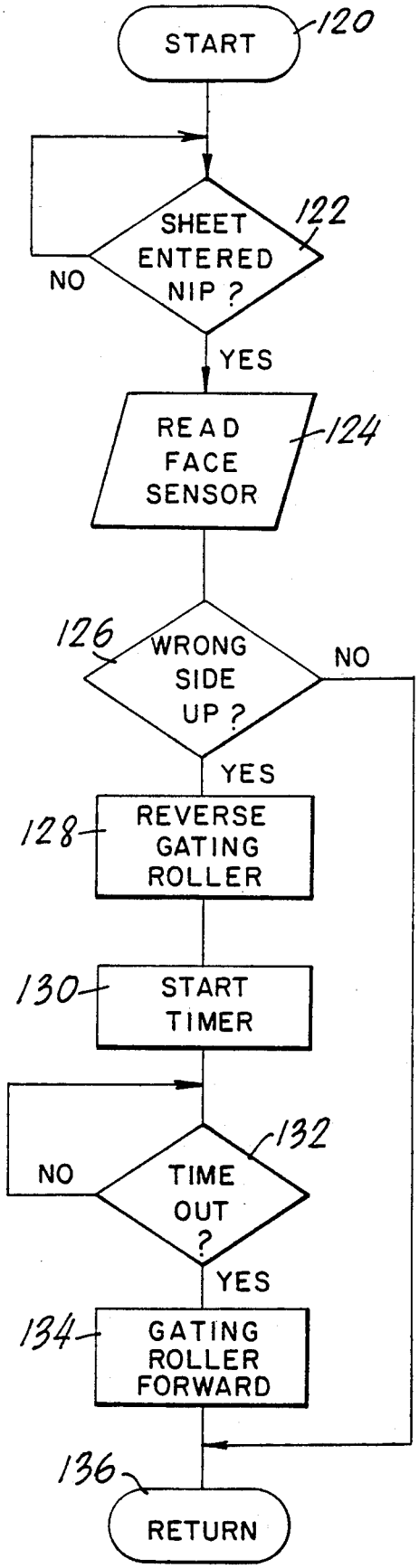
FIG. 5 is a flowchart of a routine that may be followed by the control circuit shown in FIG. 1.

FIG. 5 shows a routine that may be followed by the control system 116 shown in FIG. 1. After entering the routine (step 120) the system 116 continually interrogates sensor 106 to determine whether a sheet 14 has entered the nip formed by drive roller 38 and lower roller 60 (step 122). Upon determining that the sheet has entered the nip, the control system 116 then interrogates the face sensor 108 to determine whether the sheet 14 is correctly oriented (step 124). If the sheet is correctly oriented (step 126), the program returns (step 136) for another pass through the routine for the next sheet. If, on the other hand, the wrong side of the sheet is found to be up, the routine actuates gating-roller drive 114 in such a manner as to reverse the gating roller 72 (step 128) and starts a timer (step 130). When the timer times out (step 132) the sheet 14 should have cleared gating roller 72. At this point, the gating roller 72 is again driven in a forward direction in preparation for the next sheet (step 134). The routine then returns (step 136) for another pass as described above.

It will be seen that I have accomplished the objects of my invention. My apparatus detects and corrects incorrectly oriented documents and returns them to their proper place in the document stream. It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understook that my invention is not to be limited to the specific details shown and described.

Having thus described my invention, what I claim is:

1. Apparatus for feeding currency notes having different indicia on the opposite faces thereof from an input stack to an output path in predetermined spaced relationship including in combination means for feeding notes in spaced relationship from said input stack at a first speed, means for examining the indicia on one face of each note fed by said feeding means, means forming a first path leading directly to said output path, means forming a note-inverting path leading to said output path, said note-inverting path having a length which is greater than the length of said first path, means responsive to said indicia-examining means for selectively directing notes from said feeding means to said first path or to said inverting path so that all notes from said feeding means are delivered to said output path with the same face up, means for moving notes directed to said inverting path and means for continuously driving said note moving means to move all diverted notes through said inverting path at a second speed greater than said first speed, the product of said first path length and said first speed being substantially equal to the product of the inverting path length and the second speed so that every inverted sheet arrives at said output path at the same time it would have had it moved along said first path at said first speed.

2. Apparatus as in claim 1 in which said note-inverting path forming means is a pocket.

3. Apparatus as in claim 2 in which said pocket extends upwardly.

4. Apparatus as in claim 3 in which said note moving means comprises in input idler roll and an output idler roll and a common accelerating roll forming respective nips with said input and output idler rolls.

5. Apparatus as in claim 4 in which said directing means comprises a reversible roller in the path of the leading edge of a note being advanced by said feeding means.

* * * * *